United States Patent [19]

Fudono et al.

[11] Patent Number: 5,003,786

[45] Date of Patent: Apr. 2, 1991

[54] REFRIGERATING APPARATUS

[75] Inventors: Kanji Fudono; Hiroshi Ogawa; Toshimasa Takahashi; Toshio Yamashita, all of Aichi, Japan

[73] Assignee: Mitsubishi Jukogyo Kabushiki Kaisha, Tokyo, Japan

[21] Appl. No.: 477,764

[22] Filed: Feb. 9, 1990

[30] Foreign Application Priority Data

Apr. 7, 1989 [JP] Japan ..... 1-40521[U]

[51] Int. Cl.[5] ..... F25B 49/02; F25D 21/06

[52] U.S. Cl. ..... 62/156; 62/126; 62/128; 62/155

[58] Field of Search ..... 62/156, 155, 154, 234, 62/140, 126, 128, 129

[56] References Cited

U.S. PATENT DOCUMENTS

| | | | |
|---|---|---|---|
| 3,102,396 | 9/1963 | Laporte | 62/156 |
| 3,861,167 | 1/1975 | Nijo | 62/156 |
| 4,530,218 | 7/1985 | Janke et al. | 62/156 |

*Primary Examiner*—Harry B. Tanner

*Attorney, Agent, or Firm*—Wenderoth, Lind & Ponack

[57] ABSTRACT

A refrigerating apparatus is conventionally provided with an electric which is fed with an electric current to effect heating and defrosting operations, a defrosting control device including a defrosting timer and an evaporator outlet refrigerant temperature detector for controlling the electric current fed to the electric heater, and an overheating preventing temperature detector for preventing the occurrence of abnormal overheating by the electric heater. The refrigerating apparatus of the present invention can regularly effect defrosting even if any anomaly should arise in the evaporator outlet refrigerant temperature detector. Specifically, the overheating preventing temperature detector is connected to the defrosting control device, and a detection temperature signal from either the evaporator outlet refrigerant temperature detector of the overheating preventing temperature detector is used to commence and terminate defrosting.

1 Claim, 2 Drawing Sheets

REFRIGERATING APPARATUS

BACKGROUND OF THE INVENTION

1. Field of the Invention

The present invention relates to a refrigerating apparatus having a defrosting capability for use in a compartment.

2. Description of the Prior Art

A refrigerant circuit diagram of a refrigerating apparatus in the prior art is shown in FIG. 3. In this figure, reference numeral 1 designates a compressor, numeral 2 designates a condensor, numeral 3 designates a throttle, numeral 4 designates an evaporator, numeral 5 designates a hot gas modulating valve, numeral 6 designates a condensor fan, numeral 7 designates an evaporator fan, numeral 8 designates an electric heater, numeral 9 designates a return air temperature detector, numeral 10 designates an overheating preventing temperature detector, numeral 11 designates an evaporator outlet refrigerant temperature detector, and numeral 20 designates a controller.

A cross-sectional view of a compartment equipped with the above-described refrigerating apparatus is shown in FIG. 4. In this figure, reference numeral 12 designates the compartment, and a dash-line arrow therein indicates a flow of air. In this figure are shown the locations of the evaporator 4, the evaporator fan 7, the electric heater 8, the return air temperature detector 9 and the overheating preventing temperature detector 10.

In the above-described apparatus, a high-temperature high-pressure gas refrigerant compressed by the compressor 1 enters the condensor 2. Here, the refrigerant is cooled by air blown by the condensor fan 6 and becomes a liquid refrigerant; then, it is reduced in pressure by the throttle 3 and enters the evaporator 4, wherein it is heated by air blown by the evaporator fan 7, and it evaporates and returns to the compressor 1. At this time, the blown air is refrigerated in the evaporator 4 and is further blown out into the compartment to refrigerate the interior of the compartment.

The controller 20 compares a temperature detected by the return air temperature detector 9 with a set value corresponding to a predetermined temperature, adjusts a degree of opening of the throttle 3 and the hot gas modulating valve 5, selects an operating mode, and carries out a control operation for maintaining the temperature in the compartment 12 constant.

As the temperature in the compartment decreases, frost begins to adhere to the surface of the evaporator 4, whereby the operating efficiency of the evaporator also decreases. In order to recover this loss, the compressor 1, the evaporator fan 7 and the condensor 6 are stopped, and a defrosting mode of the evaporator 4 is effected by feeding an electric current to the electric heater 8. The timing for effecting the defrosting mode is $T_1$ minutes after the start of operation of the refrigerating apparatus or after the completion of the last defrosting cycle. Defrosting is also carried out when a temperature TE detected by the evaporator outlet refrigerant temperature detector 11 has become lower than a set value STE1. Also, the defrosting mode is ceased when a temperature TE detected by the evaporator outlet refrigerant temperature detector 11 has become higher than a set value STE2 or $T_2$ minutes have elapsed after the commencement of the defrosting mode.

When anomalies occur in the evaporator outlet refrigerant temperature detector 11, for instance, when defrosting is effected and even though the detection temperature TE is not indicated by the aforementioned detector 11 as having risen higher than the set value STE2, naturally the defrosting is forcibly finished nonetheless according to the set value $T_2$ of the timer. Therefore, in the event that only a little frost has accumulated, the timer set value $T_2$ is too long and the temperature in the container rises excessively, sometimes resulting in damage of the cargo in the compartment. Also, contrary to the above-described case, under some circumstances the apparatus does not effect the defrosting mode even though frost has accumulated to a significant degree; hence, frost adheres excessively to the evaporator and the operating efficiency thereof deteriorates.

SUMMARY OF THE INVENTION

It is therefore one object of the present invention to provide a refrigerating apparatus, in which even if anomalies should occur in an evaporator outlet refrigerant temperature detector, defrosting is effected normally.

According to one feature of the present invention, there is provided a refrigerating apparatus including an electric heater which is fed with an electric current when heating and defrosting operations are to be effected, defrosting control means having a defrosting timer and an evaporator outlet refrigerant temperature detector for controlling the electric current fed to the electric heater, and an overheating preventing temperature detector for preventing the occurrence of abnormal overheating by the electric heater, in which apparatus the overheating preventing temperature detector is connected to the defrosting control means, and a detection temperature signal of either the evaporator outlet refrigerant temperature detector or the overheat preventing temperature detector is used to terminate the defrosting operation.

According to the present invention, owing to the above-described structural feature, in order to fully utilize the temperature detecting function possessed by the overheating preventing temperature detector, this detector is connected to the defrosting control means to be used in cooperation with the evaporator outlet refrigerant temperature detector so that they both can detect temperatures for the commencement and completion of the defrosting operation. The overheating preventing temperature detector can thus be used as a backup in the case of failure of the evaporator outlet refrigerant temperature detector The above-mentioned and other objects, features and advantages of the present invention will become more apparent by reference to the following description of one preferred embodiment of the invention taken in conjunction with the accompanying drawings

DETAILED DESCRIPTION OF THE PREFERRED EMBODIMENT

Figure 3:
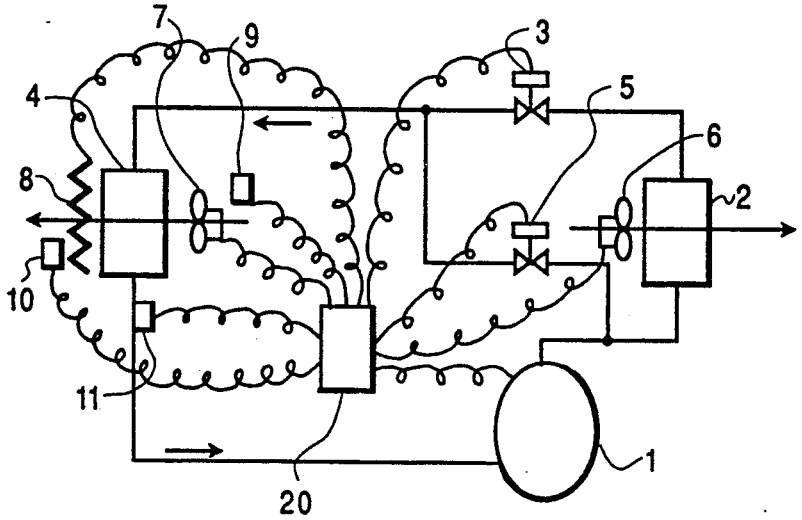
FIG.3 PRIOR ART
FIG. 3 is a refrigerant circuit diagram of a refrigerating apparatus in the prior art.
Figure 4:
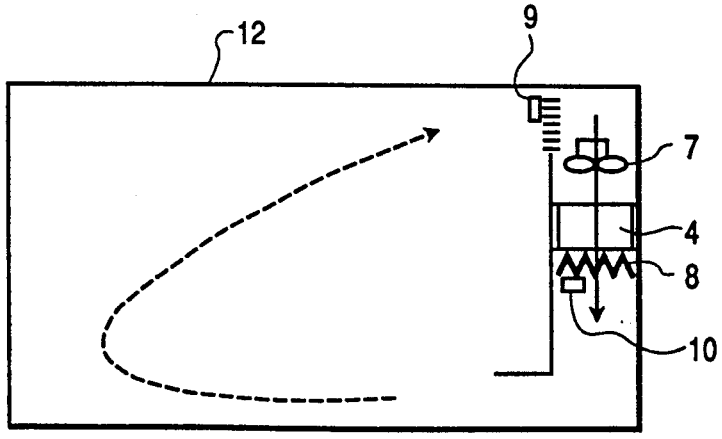
FIG.4 PRIOR ART
FIG. 4 is a cross-sectional view of a compartment equipped with a refrigerating apparatus in the prior art.

Now the present invention will be described in greater detail in connection with one preferred embodiment thereof with reference to FIGS. 1 and 2. It is to be noted that a refrigerant circuit of the refrigerating apparatus according to the illustrated embodiment and an arrangement of the refrigerating apparatus within a compartment are identical to those in the prior art as shown in FIGS. 3 and 4, respectively.

Figure 1:
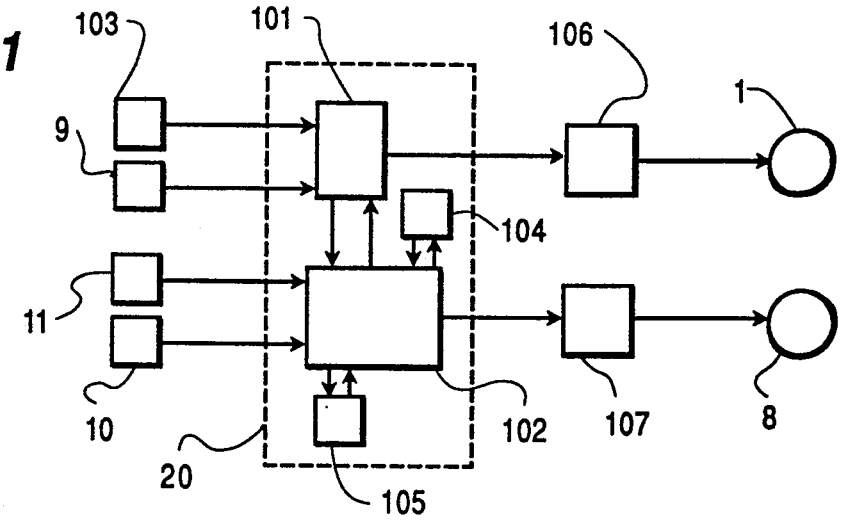
FIG. 1 is a block diagram of one preferred embodiment of the present invention.
Figure 2:
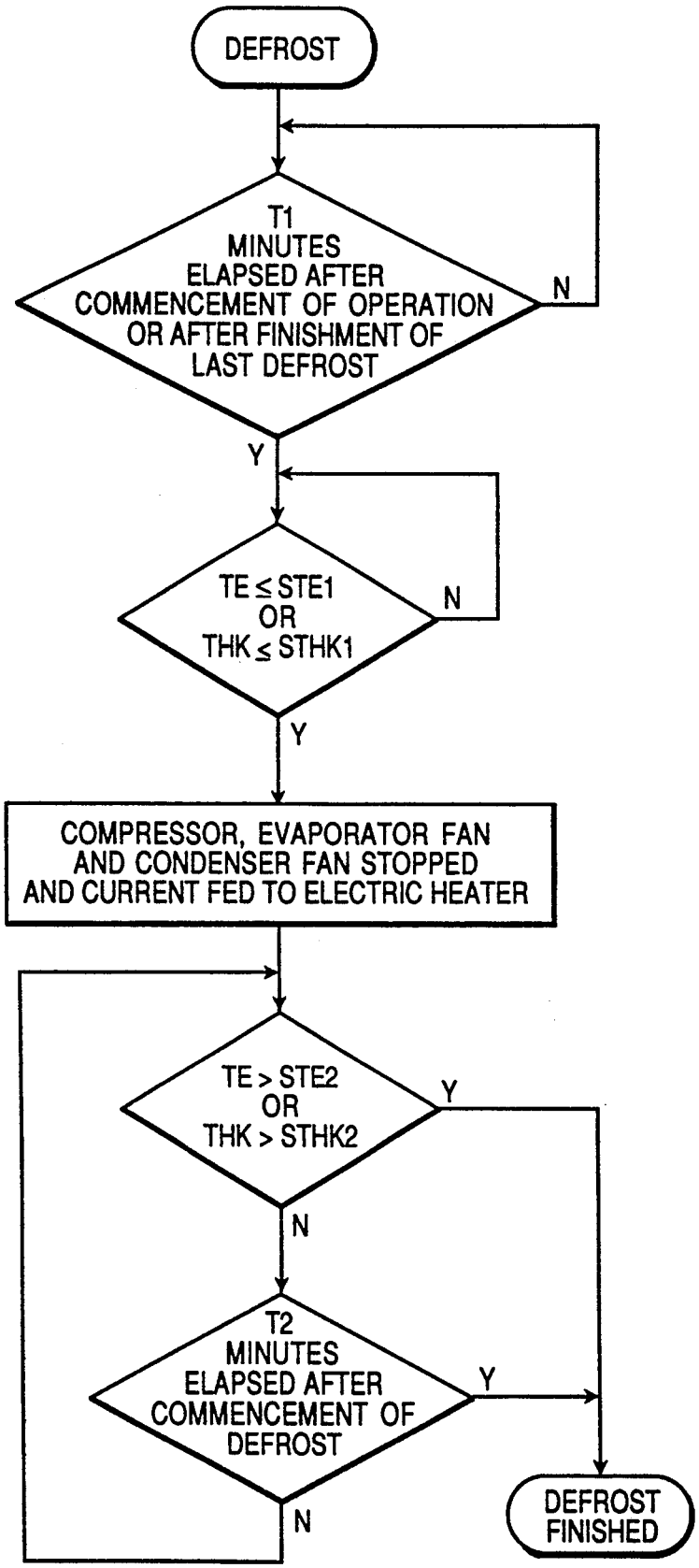
FIG. 2 is a flow chart for the control apparatus of the same preferred embodiment.

In FIG. 1, component parts designated by reference numerals 1, 8–11 and 20 are identical to those described previously in connection with the prior art. Additionally, reference numeral 101 designates temperature control means, numeral 102 designates defrosting control means, numeral 103 designates control temperature setting means, numeral 104 designates timer means A, numeral 105 designates timer means B, numeral 106 designates compressor drive means, and numeral 107 designates heater current feed means.

In the above-described apparatus, the temperature control means 101 compares a predetermined temperature established by the control temperature setting means 103 with an air temperature within a compartment detected by a return air temperature detector 9, and switches on and off a compressor 1 by controlling the compressor drive means 106, so as to maintain the temperature within the container at the aforementioned predetermined temperature. Upon the effecting of a heating mode, the temperature control means 101 sends a signal to the defrosting control means 102 and commands the heater current feed means 107 to switch on heater 8, whereby heating is effected. Furthermore, temperature control means 101 compares an air temperature within the compartment detected by the return air temperature detector 9 with the predetermined temperature, and if the air temperature within the container has become higher than the predetermined temperature, it sends a signal to the defrosting control means 102 and commands the heater current feed means 107 to switch off the heater 8.

However, when the defrosting control means 102 has sensed that the timer means A 104 indicates that a set time $T_1$ has elapsed, and that either the temperature TE detected by the evaporator outlet refrigerant temperature detector 11 or the temperature THK detected by the overheating preventing temperature detector 10 has become lower than the corresponding defrosting commencement set temperature STE1 or STHK1, the defrosting control means 102 causes the timer means B 105 to start counting and drives the heater current feed means 107 to feed an electric current to the heater 8.

Regarding the completion of defrosting, in the event that the defrosting control means 102 has sensed either that the temperature TE detected by the evaporator outlet refrigerant temperature detector 11 or the temperature THK detected by the overheating preventing temperature detector 10 has reached the corresponding defrosting completion set temperature STE2 or STHK2, or that the timer means B 105 which started counting from the commencement of the defrosting mode indicates that a set time $T_2$ has elapsed, the defrosting control means 102 commands the heater current feed means 107 to interrupt the current feed to the heater 8.

The overheating preventing temperature detector 10 is per se conventional, and an inherent function thereof is to prevent a risk of the generation of a fire, if heater 8 were to abnormally overheat, by interrupting electric current to the heater via the controller when the temperature in the proximity of the same temperature detector 10 has reached a designated value. In light of this, the designated value associated with such temperature detector in the prior art corresponds to only one temperature level, for instance, 65° C. The inventors of this invention have noted the fact that this overheating preventing temperature detector 10 continuously detects a temperature, and have modified the temperature detector 10 of the invention so as to also function when a temperature lower than the designated value, corresponding to the temperature at which defrosting is to be completed, is detected. More specifically, the temperature detector 10 is to be used in cooperation with the evaporator outlet refrigerant temperature detector 11, as a backup therefor upon failure of the evaporator outlet refrigerant temperature detector 11. In other words, the temperature detector 10 is used to detect the temperatures at which the defrosting mode is to be commenced and ceased, whereby a reliability of the apparatus has been improved.

As will be obvious from the detailed description above of the present invention, owing to the fact that in the refrigerating apparatus an overheating preventing temperature detector is connected to defrosting control means and a detection temperature signal from either an evaporator outlet refrigerant temperature detector or the overheating preventing temperature detector is used to commence and terminate the defrosting mode, even if anomalies should arise in the evaporator outlet refrigerant temperature detector, defrosting can be achieved normally.

While the present invention has been described above in connection with one preferred embodiment of the present invention, it is intended that all matter contained in the above description and illustrated in the accompanying drawings shall be interpreted to be illustrative and not limitative of the present invention.

We claim:

1. Refrigerating apparatus comprising:

a refrigerant circuit including a compressor, a condenser, a throttle and an evaporator operatively connected to one another in series so as to sequentially receive refrigerant flowing through the circuit in the apparatus;

a compartment to which said refrigerant circuit is operatively connected;

evaporator fan means operatively associated with said evaporator for circulating air through said compartment and past said evaporator so as to effect a cooling operation in which the air in the compartment is cooled in the apparatus;

electric heater means, including an electric heater, operatively associated with said evaporator for facilitating a heating operation in which air in the compartment is heated in the apparatus and for heating any frost adhered to said evaporator to effect a defrosting operation in the apparatus;

an overheating preventing temperature detector for detecting the temperature of air in the vicinity of said electric heater;

an evaporator outlet refrigerant detector for detecting the temperature of the refrigerant at the outlet of said evaporator; and a controller for effecting refrigerating cycles in the apparatus which include respective ones of the cooling, the heating and the defrosting operations, said controller including first timer means for counting time starting from when the controller has commenced operation and for counting time starting from when a said defrosting operation has been completed, second timer means for counting time starting from when a said defrosting operation is initiated, and defrost control means operatively connected to said electric heater means, to said evaporator outlet refrigerant detector and to said first timer means for turning said electric heater on to initiate a said defrost operation once said first timer means has counted a predetermined period of time $T_1$ if the temperature detected by said evaporator outlet refrigerant detector is less than a predetermined temperature STE1, for turning said electric heater off to terminate a said defrost operation when said second timer means has counted a predetermined period of time $T_2$, and for turning said electric heater off to terminate a said defrost operation if the temperature detected by said evaporator outlet refrigerant detector is greater than a predetermined temperature STE2, said defrost control means also operatively connected to said overheating preventing temperature detector for turning said electric heater on to initiate a said defrost operation once said first timer means has counted said predetermined period of time $T_1$ and if the temperature detected by said overheating preventing temperature detector is less than a predetermined temperature STHK1, and for turning said electric heater off to terminate a said defrost operation if the temperature detected by said overheating preventing temperature detector is greater than a predetermined temperature STHK2.

* * * * *